US005680905A

United States Patent [19]

Green et al.

[11] Patent Number: 5,680,905

[45] Date of Patent: Oct. 28, 1997

+

[54] APPARATUS AND METHOD FOR PERFORATING WELLBORES

[75] Inventors: Robert R. Green; William D. Myers, both of Houston, Tex.

[73] Assignee: Baker Hughes Incorporated, Houston, Tex.

[21] Appl. No.: 368,693

[22] Filed: Jan. 4, 1995

[51] Int. Cl.[6] ..... E21B 43/11

[52] U.S. Cl. ..... 175/4.54; 175/4.56; 166/297

[58] Field of Search ..... 175/4.52, 4.54, 175/4.56; 166/297, 298

[56] References Cited

U.S. PATENT DOCUMENTS

| | | | |
|---|---|---|---|
| 2,719,485 | 10/1955 | Bendar | 102/20 |
| 4,538,680 | 9/1985 | Brieger et al. | 175/4.56 X |
| 4,544,034 | 10/1985 | George | 166/297 |
| 4,566,544 | 1/1986 | Bagley | 175/4.56 |
| 4,610,312 | 9/1986 | Nelson | 175/4.52 |
| 4,633,945 | 1/1987 | Upchurch | 166/55.1 |
| 4,911,251 | 3/1990 | George | 175/4.54 |
| 4,969,525 | 11/1990 | George | 166/297 |
| 5,161,616 | 11/1992 | Colla | 166/297 |
| 5,215,148 | 6/1993 | Ricles | 175/4.56 X |
| 5,540,293 | 7/1996 | Mohaupt | 175/4.56 X |

*Primary Examiner*—William P. Neuder
*Attorney, Agent, or Firm*—Madan & Morris

[57] ABSTRACT

An apparatus for actuating a firing head is disclosed. The apparatus contains a firing head that is operatively connected to a detonating cord of a perforating gun containing a series of shaped charges. The perforating gun will be connected to a work string in a wellbore filled with a fluid. The apparatus generally comprises a housing member having an inner portion and an outer portion; a blocking member for blocking passage of a hydrostatic pressure; a mechanical activation piston, adapted to be received within the housing member, for mechanically opening the blocking member. The apparatus further contains a hydraulic activation piston, adapted to be received within the housing member, for activating a percussion initiator firing member; and a transfer charge booster that transfers the detonation to a detonation cord.

21 Claims, 5 Drawing Sheets

APPARATUS AND METHOD FOR PERFORATING WELLBORES

BACKGROUND OF THE INVENTION

This invention relates to the perforating of wellbores. More particularly, but not by way of limitation, this invention relates to a firing mechanism for a perforating apparatus.

In order to produce oil and natural gas from subterranean reservoirs, operators will drill a bore hole through a series of subterranean reservoirs. Thereafter, a series of casing strings may be set in the bore hole. As is well known in the art, the casing string is then cemented into place. Communication between the casing string annulus and reservoir then becomes necessary for the production of the hydrocarbons.

Perforating is the process of piercing the casing wall and the cement to provide openings through which formation fluids and gas may enter. Perforating may also be used to provide openings in the casing so that materials may be introduced into the annulus between the casing and the wall of the bore hole such as cement for squeeze cementing jobs.

Through the years, various devices have been employed in order to perforate casing strings including jet perforators and bullet perforators. Currently, the more popular technique used is that of jet perforator which uses a shaped-charge explosive.

The charge necessary to penetrate the casing, cement, and formation must be quite powerful. In fact, the further that the shape charge penetrates into the formation, the better the ultimate completion. Techniques include lowering a perforating gun on electric line, and perforating the casing by electrically firing an electric detonator device which causes the detonating cord and the attached shaped charges to detonate.

Another factor in designing completions is the speed in which the completion can be concluded. Therefore, various techniques have been developed that include lowering the shaped charges on the end of a production tubing string and actually running into the wellbore the permanent production string with the perforating gun. Once positioned properly, the perforating gun is fired. The methods and devices used to detonate the guns include mechanical and hydraulic means. The use of mechanical means will include dropping a metal bar from the surface which ultimately strikes a mechanical piston which in turn initiates the detonation. Also, hydraulic means have been employed that utilize hydraulic piston means responsive to pressure in order to initiate detonation.

Despite these advances, numerous problems exist with the prior art devices. Since the charges employed are very powerful, extreme care must always be employed to assure no detonation can occur at the surface and that detonation can only occur below the surface. Also, it is desired that the gun fire at the proper depth since early detonation will result in holes in the casing at undesirable depths. Further, if the guns do not fire for whatever reason such as mechanical problems due to the complexity of design, and it is necessary to pull out of the wellbore with the loaded guns, another potentially dangerous situation exist as well as the added expense incurred.

Some prior art devices have attempted to address these problems. For instance, in U.S. Pat. No. 4,911,251 to George et al, the inventors disclose a firing mechanism that utilizes multiconcentric firing pistons, multi-shear pins and multi-collets. While the device is run into the wellbore, one side of the multiconcentric firing pistons is under constantly increasing hydrostatic pressure. The firing head may be activated either by hydraulic or mechanical means. However, if a mechanical impact occurs prematurely at the surface or for some reason in the wellbore at a shallow depth, the device could detonate prematurely while running in the hole since the hydrostatic pressure is now free to move the firing pin into contact with the initiator.

Therefore, the invention of the present application solves these and other problems of the prior art devices as will be clear from the following detailed description.

SUMMARY OF THE INVENTION

An apparatus for actuating a firing head is disclosed, with the firing head being operatively connected to a detonating cord of a perforating gun containing a series of shaped charges. The perforating gun will be connected to a work string in a wellbore filled with a fluid. The apparatus generally comprises a housing member having an inner portion and an outer portion; an apparatus for blocking passage of a hydrostatic pressure a mechanical adapted to be received within the housing member, for mechanically opening the apparatus for blocking passage of the hydrostatic pressure labrynth seal firing piston adapted to be received within the housing member, for activating a percussion initiator firing member; and a booster for transferring the detonation to a detonating cord.

The apparatus may further contain an atmospheric chamber formed within the housing member, and wherein the labrynth seal firing piston is received within the atmospheric chamber so that a first and second chamber is formed. In one embodiment, the device for opening the blocking device will contain a passageway for allowing communication of a pressure within the wellbore to communicate with the device for blocking passage of a hydrostatic pressure. The atmospheric chamber is formed by the device for blocking passage of a hydrostatic pressure sealing engaging the inner housing member.

In another embodiment, the labrynth seal firing piston contains a first end, a second end and an outer periphery, wherein the outer periphery has formed thereon a series of grooves that allows for a slow leak to pressurize the second atmospheric chamber thereby equalizing pressure between the first and second chambers, and prevent activation of the percussion initiator. However, the series of grooves allows a rapid increase in pressure on the first end of the labrynth seal firing piston to cause a pressure differential between the first end and the second end thereby activating the percussion initiator.

Further, the device for opening the blocking device may be a mechanical pin member having a first end and a second end, with the pin member being slidably disposed within the housing member. The device for blocking passage of a hydrostatic pressure may contain a rupture membrane, with the rupture membrane containing a first end and a second end, and wherein the first end contains a frangible material that is piercable by the second end of the mechanical pin or may be ruptured by a sufficient hydrostatic pressure.

The apparatus may also include a retainer operatively associated with the mechanical pin and the housing member, for retaining the pin in a first position, the retainer having a preset value in order to resist movement of the pin from the first position to a second position.

The apparatus may also contain a bar member, with the bar member being of sufficient weight to force the pin from the first position to the second position.

The application also discloses a method of initiating an explosive charge for a perforating gun with a hydraulic actuation device. In this embodiment, the hydraulic actuation device may comprise a housing member attached to the work string, with the work string having an inner diameter and an outer diameter; a mechanical pin slidably mounted within said housing; a rupture disc which sealingly engages the inner housing member so that an atmospheric chamber is formed therein; a hydraulic firing piston slidably received within the housing; an initiator for initiating a detonation to a booster operatively connected to a detonating cord for detonating a series of shape charges on the perforating gun.

The method comprises the steps of lowering the perforating gun having the detonating cord with the device attached thereto; orienting the perforating gun with a hydrocarbon bearing zone; and setting a packer against the wellbore casing.

The method may further comprise the steps of dropping a bar member so that the mechanical pin is forced into the rupture disc so that the rupture disc is broken. Next, the atmospheric chamber will be rapidly surged with the wellbore fluid hydrostatic pressure, and the hydraulic firing piston will move into engagement with the initiator.

The method may also include the steps of impacting the initiator sufficiently to cause the explosives of the initiator to detonate, and transferring the detonation to the booster. Thereafter, the detonating cord is detonated, which in turn detonates the shaped charges.

As an alternate method, the application discloses the steps of applying surface pressure to the wellbore system's hydrostatic pressure which will in turn burst the rupture disc. This will then cause the atmospheric chamber to be surged with the wellbore fluid's hydrostatic pressure thereby moving the hydraulic piston into engagement with the initiator. The method further comprising the steps of impacting the initiator means sufficiently to cause the explosives of the initiator to detonate and transferring the detonation to the booster. Thereafter, the detonating cord will be detonated, which will in turn detonate the shaped charges.

A feature of the present invention includes the use of a mechanical pin, which in order to arm the firing head, may be mechanically forced from a first position to a second position. Another feature includes use of a rupture disc with a rupture membrane that can be selected for rupture at different forces.

Still yet another feature is that the rupture membrane can be forced open by the mechanical pin means, or alternatively, by the force of a predetermined applied hydrostatic pressure. Still yet another feature is that the rupture disc contains thereon a seal for forming an atmospheric chamber within the housing.

Another feature includes use of a labyrinth sealing firing piston that allows fluid to leak past the piston; however, in the event that pressure is surged to the first side of the labyrinth piston, the labyrinth piston will move from a first position to a second position.

An advantage of the invention includes use of a two-step procedure before detonation of the detonating cord can be accomplished. The first step includes arming the firing head and the second step includes hydraulic actuation. Another advantage includes that the first step of arming the firing mechanism may be accomplished mechanically or alternatively, hydraulically.

Another advantage includes that in case of a leak into the atmospheric chamber, no detonation will occur. Further, an advantage includes that the two-step procedure can be accomplished utilizing purely hydraulic method. Another advantage includes the operator can select the rupture disc membrane to rupture at specific hydrostatic pressures. Still yet another advantage is the firing mechanism can be adapted to be run on tubing, coiled tubing or wire line.

BRIEF DESCRIPTION OF THE INVENTION

DESCRIPTION OF THE PREFERRED EMBODIMENTS

Figure 1:
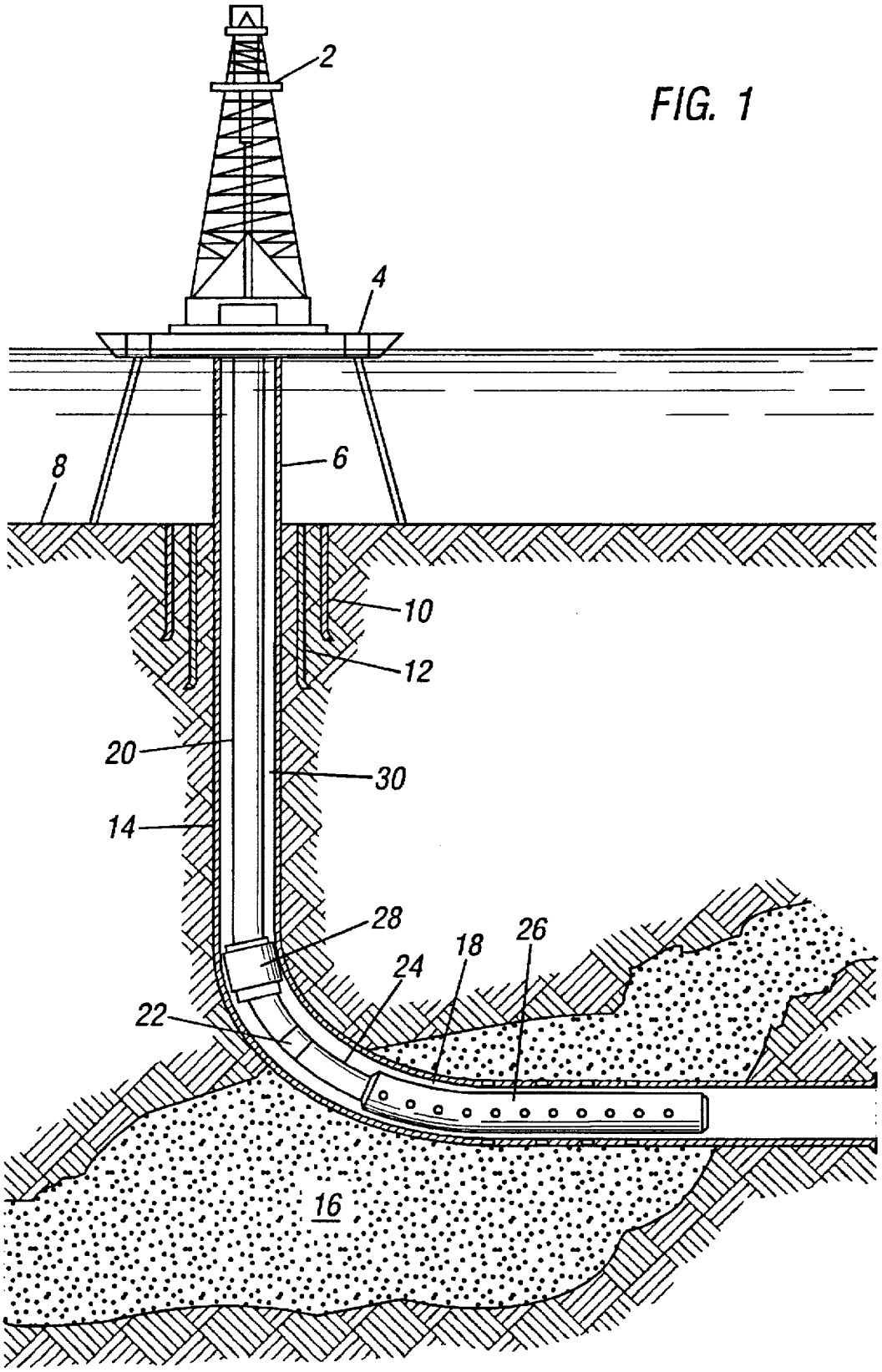
FIG. 1 is an illustration of a semi-submersible drilling rig with a wellbore extending therefrom.

Referring to FIG. 1, a typical drilling rig 2 positioned on a semi-submersible drilling platform 4 is shown. Extending from the platform 4 is a riser 6 that runs to the sea floor 8. A series of casing strings 10, 12, 14 penetrate the subterranean reservoirs that have been drilled through by a bit means (not shown) as will be appreciated by those of ordinary skill in the art. After the drilling phase, the casing strings 10, 12, 14 are cemented into place.

The production casing string 14 will penetrate a reservoir 16 that will contain hydrocarbons. In order to produce the hydrocarbons, it is necessary to communicate the wellbore annulus 18 with reservoir 16 by perforating the casing string 14 and the cement that directly surrounds the casing 14.

In accordance with the teachings of the present invention, a work string 20, which could be drill pipe, production tubing, coiled tubing or wire line, is lowered into the wellbore 14. The work string 20 will have attached thereto a bottom hole assembly 22, with the bottom hole assembly including the firing head apparatus 24 and operatively connected thereto the perforating gun 26 containing a series of shaped charges. The work string 20 may also have a packer 28 for sealingly engaging the walls of the casing string 14 so that the lower annulus 18 and upper annulus 30 is formed.

Figure 2A:
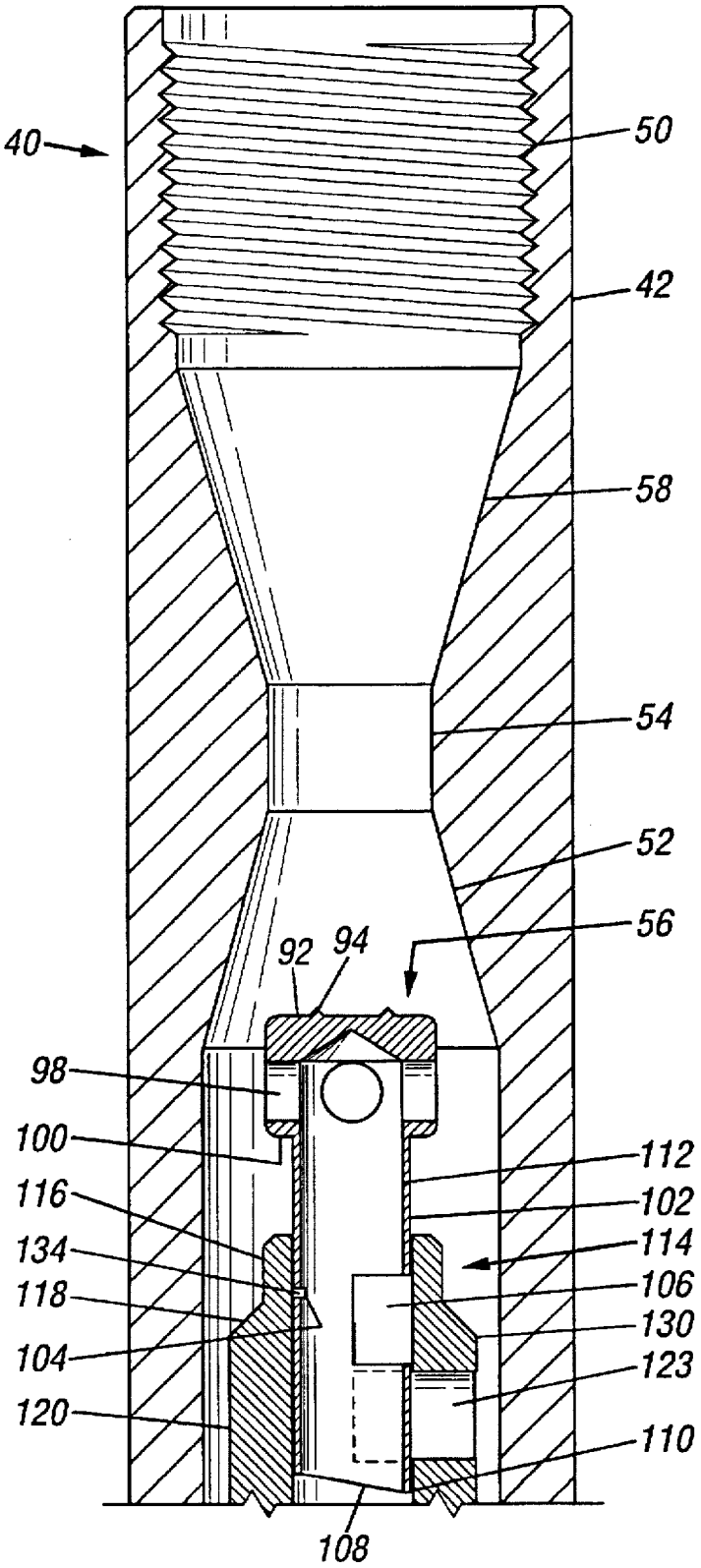
FIGS. 2A–2B are schematic cross-section views of a bottom hole assembly containing the apparatus of the present invention before firing.
Figure 2B:
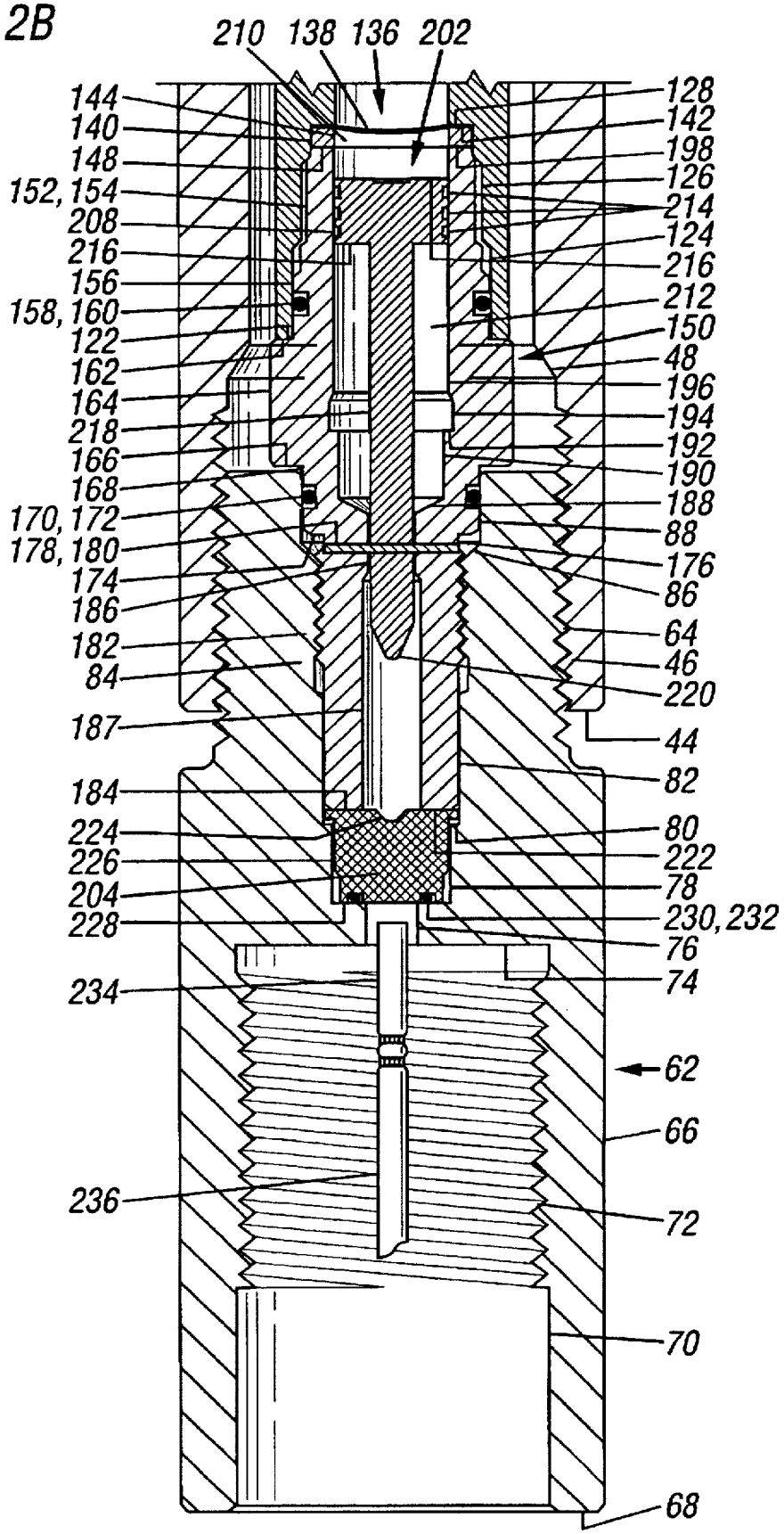

Referring now to FIGS. 2A–2B, the preferred embodiment of the invention will now be described. It should be noted that throughout the application, like numerals of the various figures refer to like components of the apparatus. The work string 20, which may be a production tubing, will have connected thereto a cylindrical guide sub 40 that will have an outer diameter surface 42 that will extend to a radial surface 44, that in turn extends to internal thread 46.

Internal thread 46 extend to a chamfered surface 48 that in turn leads to a smooth bore 50, with the bore 50 concluding at the chamfered surface 52. The surface 52 then extends to the a second smooth bore 54 that provides a guide path for passage of the weight bar (not shown) that is used to mechanically shift the device for opening the blocking device seen generally at 56, which will be described in further detail later in the application. The bore 54 then concludes at chamfered surface 58 which in turn extends to the internal thread 60.

The guide sub 40 is threadedly connected to the firing head housing 62. Generally, the housing 62 contains external thread 64 that in turn extends to the outer surface 66, with the outer surface concluding at the radial shoulder 68. On the inner diameter, the bore 70 leads to the internal thread 72 which in turn concludes at the radial shoulder 74, with the shoulder 74 terminating at the reduced surface 76 that in turn leads to a second reduced surface 78. The second reduced surface 78 extends to radial shoulder 80 that in turn leads to the inner surface 82 that will have contained thereon internal thread 84, with the thread 84 continuing to the chamfered surface 86 and the inner surface 88.

As seen in FIG. 2A?, the device for opening the blocking device 56 will now be described. The device for opening the blocking device 56 is generally a pin member that has a radial surface 92 that is adapted to receive the weight bar (not shown). The radial surface 92 has contained thereon a radial protrusion 94 for leaving an impression on the weight bar for inspection when fished or retrieved. The radial surface 92 continues to the outer surface 96 that will have a passageway 98 formed therein.

The surface 96 continues to the radial surface 100 which in turn terminates at the outer surface 102, with the outer surface 102 having a first opening 104 and a second opening 106. The outer surface 102 terminates at the angled surface 108 having angled end 110. Extending internally of the surface 102 is the inner diameter 112 that contains the same openings 104 and 106 previously described.

The pin 56 will be positioned within the upper firing head module 114. Generally, the module 114 contains a first outer surface 116 that extends to the chamfered surface 118 which in turn continues to the second outer surface 120 that terminates at the radial surface 122, with the outer surface 120 containing the opening 123. Extending radially inward, the inner bore surface 124 will have contained thereon threads 126 which then extends to the radial shoulder 128. The radial shoulder 128 then extends to the inner bore 130 that has the previously described opening 123, with the inner bore concluding at the radial shoulder 132.

The pin 56 is retained in a first position, such as shown in FIG. 2A, by a retainer which in the preferred embodiment is a shear pin 134 fitted through the opening 104 and into another opening (not shown) on the upper firing head module 114.

Also positioned within the upper firing head module is the device 136 for blocking passage of a hydraulic fluid and/or gas. In the preferred embodiment, the device for blocking passage of a hydrostatic pressure 136 is a rupture disc with a frangible membrane 138, with a back-up ring member that has an outer surface 140 that terminates at the radial shoulder 142 that contains a slight bevel, with the shoulder 142 in turn extending to the inner bore surface 144 that in turn stretches to the radial shoulder 146. The radial shoulder 142 cooperates with and forms a metal-to-metal seal with the radial shoulder 128 of the upper firing head module so that an atmospheric chamber is formed, which will be described in greater detail later in the application.

As seen in FIG. 2B?, the lower firing head module 150 will now be described. The lower module generally includes a first outer surface 152 that has contained thereon external thread 154 that will engage with the thread 126 of the upper module 114. The surface 152 extends to the second outer surface 156 that will have a groove 158 thereon for placement of seal such as an o-ring 160. The second outer surface 156 then extends to the radial shoulder 162 that engages with the radial surface 122 of the upper firing head module.

The radial shoulder 162 concludes at the third outer surface 164, that in turn extends to the radial shoulder 166 which in turn leads to the fourth outer surface 168. The outer surface 168 will have contained thereon a groove 170 for placement of an o-ring 172 that will sealingly engage with the inner surface 88 of the firing head housing 62. The outer surface 168 concludes at the radial surface 174 which in turn extends to the fifth outer surface 176 that will have contained therein opening 178 for placement of a retainer 180 which in the preferred embodiment is a shear pin as well as external thread 182 that threadedly engage with the internal thread 84. The outer surface 176 terminates at radial surface 184.

On the inner diameter of the lower firing head module 150 is the first internal bore surface 186 that has the previously mentioned opening 178, with the first bore surface 186 also containing an undercut section 187 which prevents any burrs from the shear pin from sticking and hanging up the hydraulic activation means 202. The internal surface 186 extends to the angled surface 188, with the angled surface 188 extending to the second bore surface 190. The second bore surface 190 terminates at the radial surface 192 that extends to the third and fourth internal bore surfaces 194, 196 respectively. The fourth bore surface terminates at the radial shoulder 198.

Referring now to FIG. (2B), the labrynth seal firing piston 202 for activating the percussion initiator firing member 204 will now be described. The labrynth seal firing piston 202 contains a radial surface 206 that extends to a first cylindrical outer surface 208, with the first outer surface 208 seal forming a labyrinth engaging the fourth bore surface 196. Thus, a first chamber 210 and a second chamber 212 are formed therein. The device for blocking passage of a hydrostatic pressure 136, as previously mentioned, allows for both chambers 210 and 212 to be atmospheric chambers.

The outer surface 208 will contain a series of grooves 214 that allow for the condition wherein if the hydrostatic pressure is leaked slowly past the device for blocking passage of a hydrostatic pressure into the first chamber 210, such that the grooves will allow the pressure to equalize into the second chamber 212 thus preventing an unwanted premature firing. However, the design of the labyrinth seal firing piston allows for the case wherein the first chamber 210 undergoes a surge in pressure (such as when the device for blocking passage of a hydrostatic pressure 136 is ruptured) to maintain the second chamber 212 under atmospheric pressure. Thus, by having the first chamber 210 under pressure, and the second chamber 212 under atmospheric conditions, a force is created sufficient to shear the pin 180 forcing the labyrinth seal piston 202 downward.

The outer surface 208 terminates at the radial shoulder 216 which in turn extends to the second outer surface 218, with the second outer surface 218 terminating at the piercing end 220. The percussion initiator firing member 204 is positioned within the firing head housing 62.

The percussion initiator 204 generally comprises a radial surface 222 that will engage the radial surface 184 of the lower firing head module 150. The radial surface 222 will have a cavity 224 that is adapted to receive the piercing end 220 of the labyrinth seal piston 202. Extending from the radial surface 222 is the outer surface 226 which concludes at the radial surface 228 that will contain a channel 230 for placement of an o-ring 232.

Operatively connected to the percussion initiator firing member is the booster 234 that transfers detonation from the initiator to the detonating cord 236. As is well understood by those of ordinary skill in the art, the detonation cord is connected to a series of shaped charges on the perforating gun.

In operation, the entire apparatus is lowered into the wellbore 14, as depicted in FIG. 1. The depth of the shaped charges is correlated, and the packer is set so that the shaped charges on the perforating gun 26 are adjacent the reservoir 16. The shaped charges will have the detonation cord 236 operatively attached thereto. The firing head mechanism will be in the position as seen in FIGS. 2A–2B.

Figure 3A:
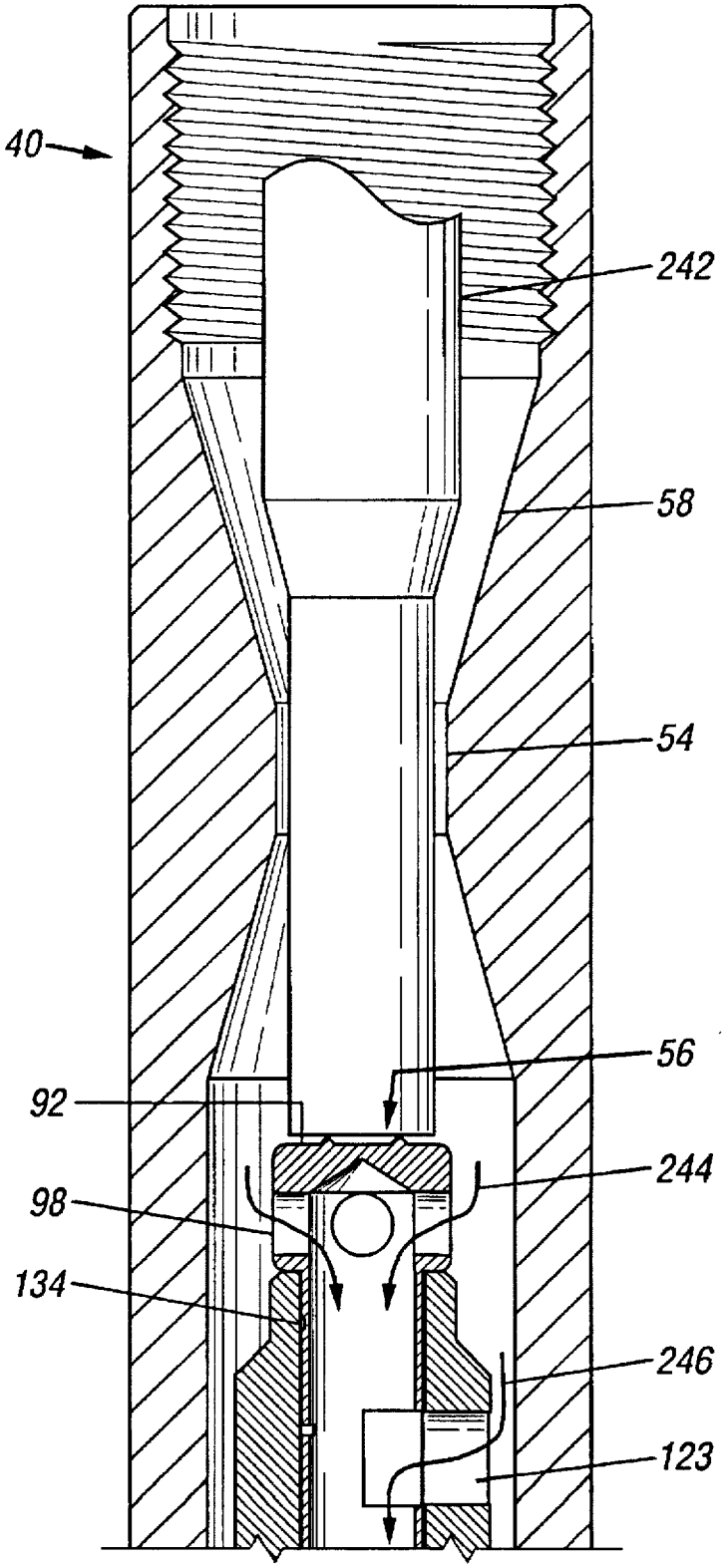
FIGS. 3A–3B are schematic cross-section views of the apparatus of FIGS. 2A–2B after the apparatus has been detonated.
Figure 3B:
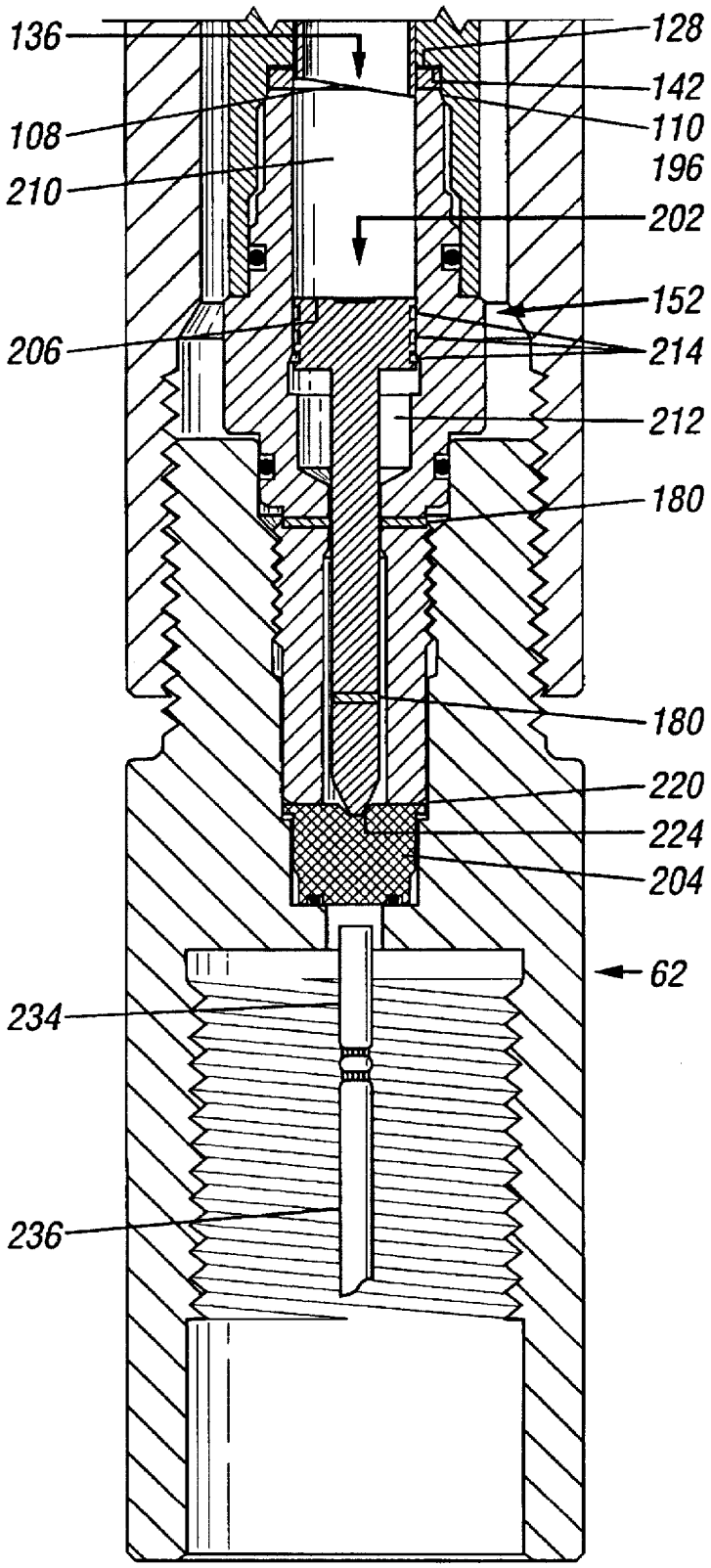

Referring to FIGS. 3A–3B, the weight bar 242 is dropped from the surface. It should be noted that other means for shifting the device for opening the blocking device 56 could be used such as utilizing an electro-mechanical actuation device for mechanically striking the pin 56. The electro-mechanical device may be actuated by the electric current being supplied by electric line or other surface signaling methods. The bar member 240 or electro-mechanical device must be of sufficient energy to create sufficient force to shear the retainer 134, so that the mechanical pin 56 is forced downward as seen in FIG. (3B). With the downward movement of pin 56, the angled end 110 of the angled surface 108 will rupture the membrane 138 of the device for opening the blocking device 136. The hydrostatic pressure of the wellbore 14 will then be communicated with the first atmospheric chamber 210 as indicated by the flow lines 244 and 246. The flow 244 enters through the passageway 98 and down through the inner portion of the piston 56. The hydrostatic pressure may also be allowed through the opening 123 since the pin 56 has been shifted down allowing the alignment of opening 106 of the pin with the opening 123 of the upper firing module 114.

Thus, by allowing the flow 244 and 246, the hydrostatic pressure will be surged into the atmospheric chamber 210. Since the chamber 212 is still under atmospheric conditions, a pressure differential will exist. Thus, the pressure differential must be sufficient to create a force that will shear retainer 180 so that the labrynth seal firing piston 202 impacts with the percussion initiator 204.

Once the pin 180 is sheared, the piercing end 220 of the hydraulic firing piston 202 will be forced (due to the surge of pressure within the atmospheric chamber 210) down so that the piercing end impacts the percussion initiator 204 in the cavity 224. Once impacted, the explosives of the percussion initiator 204 detonate. Thereafter, the detonation will be transferred to the booster 234. Next, the shape charges of the perforating gun 26 are fired by the detonation of the detonating cord 236.

In the event that the dropping of the weight bar 242 is either not practical or not effective, the present invention allows for activation hydraulically. The method of initiating the explosive charge for the perforating gun would include applying hydrostatic pressure to the well casing 14. Since the frangible rupture membrane 138 is selected such that the amount of force needed to rupture can be varied and selected by the operator, a frangible rupture membrane 138 can be selected that will coincide with the proper wellbore 14 depth plus the desired surface applied pressure.

Thus, the operator will increase the pressure of the wellbore system to a predetermined amount so that the frangible membrane 138 burst. The pressure is communicated to the rupture membrane 138 via the passageway 98, through the mechanical pin 56 inner bore. Note, in this mode of activation, the mechanical pin 56 will not be shifted downward, and therefore, FIGS. 3A–3B do not depict this scenario.

Once the rupture membrane bursts, the hydrostatic pressure from the well will surge into the atmospheric chamber 210, as previously described with the wellbore fluid hydrostatic pressure. The surge of the hydrostatic pressure acting against the radial surface 206 will shear the retainer 180. After the pin 180 is sheared, the piercing end 220 of the hydraulic piston 202 will be forced (due to the surge of pressure within the atmospheric chamber 210) down so that the piercing end impacts the percussion initiator 204 in the cavity 224. Following the impact, the explosives of the percussion initiator 204 will detonate. Thereafter the detonation will be transferred to the booster 234. Next, the shaped charges of the perforating gun 26 are fired by the detonation of the detonating cord 236.

In the event the pressure is being leaked into the atmospheric chamber 210, the series of grooves 214 of the labyrinth piston 202 will allow the leak to be communicated to the second atmospheric chamber 212, thus effectively disarming the firing head. Since the series of grooves 214 will allow for this communication, the pressure in the first chamber 210 will equalize with the pressure in the second chamber 212 and a differential force sufficient to shear the pin 180 can not be created.

Also, in the event the mechanical piston 56 is impacted or shifted by some cause at or near the surface such that the retainer 134 is sheared and the angled end ruptures the membrane 138 as the system is lowered in the wellbore, the firing head will not activate since a pressure differential between atmospheric chambers 210 and 212 is not created due to the labyrinth seal feature of allowing the pressure in the chambers 210 and 212 to equalize. Thus, the piercing end 220 will not be forced downward to impact the percussion initiator firing member.

Changes and modifications in the specifically described embodiments can be carried out without departing from the scope of the invention which is intended to be limited only by the scope of the appended claims.

We claim:

1. A apparatus for initiating a charge of a perforating gun at a selected location in a wellbore having a hydrostatic pressure comprising:

(a) a housing;

(d) a piston in the housing, said piston having a seal member slidably disposed within said housing, said seal member defining a first chamber and a second chamber in the housing, said seal member including a fluid path for slowly equalizing pressure between the first and second chambers and preventing such equalizing of the pressure between the chambers when hydrostatic pressure is applied to the piston;

(c) a rupture member disposed within said housing for sealing the piston from the hydrostatic pressure; and (d) a piercing member slidably disposed within said housing, said piercing member adapted to rupture the rupture member upon the application of a mechanical force to the piercing member to break the seal between the rupture member and the firing piston and allowing the application of the hydrostatic pressure to the piston.

2. The apparatus according to claim 1, wherein the piston has a first end and a second end and wherein the first chamber is formed between the rupture member and the first end of the piston.

3. The apparatus according to claim 2, wherein said seal member of the piston has a series of grooves forming a labyrinth seal between the housing and the piston.

4. The apparatus according to claim 3, wherein the piston includes a penetration member at the second end for activating a charge initiator.

5. The apparatus according to claim 2, wherein the rupture member includes a frangible material.

6. The apparatus according to claim 1, wherein the piercing member includes a passageway for providing a passage for the application of the hydrostatic pressure to the rupture member.

7. The apparatus according to claim 1, further comprising a retaining device operatively connected to said piercing member for retaining the piercing member in a the first position.

8. The apparatus according to claim 2, wherein said housing has a first end and a second end, and wherein said first end is connected to a work string and said second end to the perforating gun and wherein said initiating member is positioned so as to cause a transfer of the detonation to a detonating cord for detonating a series of shaped charges.

9. A perforating gun for perforating a wellbore at a selected location in a wellbore having a hydrostatic pressure fluid, comprising:

(a) a housing;

(b) an atmospheric chamber formed within said housing;

(c) a firing member in the atmospheric chamber for activating a firing initiator in the perforating gun, said firing member having formed grooves thereon that allow for a slow leak to equalize pressure within the atmospheric chamber to prevent activation of said firing initiator in an initial mode of operation but allow activation of the initiator upon the sudden application of the hydrostatic pressure fluid on the firing member;

(d) a blocking member in the housing for blocking passage of the hydrostatic pressure fluid to the firing member in the initial mode of operation; and (e) an opening device adapted to be received within said housing for opening said blocking member upon the application of a mechanical force to the opening device, said opening device having a passageway for allowing application of the hydrostatic pressure fluid to the blocking member upon the opening of the blocking member.

10. The perforating gun according to claim 9 further comprising a transfer charge booster that is activated by the firing member for transferring detonation to a detonation cord.

11. The perforating gun according to claim 10, wherein the opening device is a pin slidably disposed in the housing.

12. The perforating gun according to claim 11, wherein said blocking member includes a rupture membrane having a frangible material that is piercable by said pin.

13. The perforating gun according to claim 11, wherein said blocking member includes a rupture membrane having a frangible material that is ruptured by a predetermined hydraulic pressure.

14. The perforating gun according to claim 12 further comprising a retaining member operatively associated with said pin and said housing for retaining said pin in a first position.

15. The perforating gun according to claim 14 further comprising a bar member having sufficient weight to force said pin from the first position to a second position.

16. The perforating gun according to claim 15 further having a series of shaped charges adapted to perforate the wellbore upon detonation.

17. A perforating gun for perforating a casing in a wellbore having a hydrostatic pressure, comprising:

(a) a housing;

(b) a firing piston slidably disposed in the housing, said firing piston forming a first chamber and a second chamber in the housing and forming a fluid leak path between the first and second chambers that allows a fluid to slowly leak between the first and second chambers, thereby equalizing the pressure between the first and second chambers, said firing piston adapted to move from a first normal position to a second firing position upon the sudden application of the hydrostatic pressure to the first chamber to cause an initiator to activate a charge;

(c) a blocking member disposed in the housing, said blocking member allowing the application of the hydrostatic pressure to the first chamber when it is ruptured; and (d) a piercing member disposed in the housing, said piercing member adapted to be moved from a first position to a second position upon the application of a mechanical force, said piercing member rupturing the blocking member when it is moved to the second position, causing the application of the hydrostatic pressure to the first chamber.

18. A perforating gun, comprising:

(a) housing;

(b) a firing piston disposed in the housing, said firing piston adapted to move from a first position to a second position upon the application of a hydraulic pressure thereto, said firing piston initiating a charge when moved to the second position, said firing piston also adapted to slowly equalize pressure across the firing piston when it is in the first position; and (c) a rupture member in the housing, said rupture member adapted to be ruptured upon the application of a mechanical force, said rupture member allowing the application of the hydraulic pressure on the firing piston to move when it is ruptured, thereby causing the firing piston to move from the first position to the second firing position.

19. A perforating gun for use in a wellbore at a downhole location having a hydrostatic pressure, comprising:

(a) a charge initiator for initiating a charge when said charge initiator is moved from an inoperative position;

(b) a firing device in the gun, said firing device maintained at a pressure below the hydrostatic pressure prior to operating the perforating gun, said firing device causing the initiator to move from the inoperative position upon the application of the hydrostatic pressure to the firing device;

(c) a rupture member disposed in the perforating gun for maintaining the firing member at a pressure below the hydrostatic pressure, said rupture member allowing the hydrostatic pressure to be applied to the firing device when the rupture member is ruptured by a mechanical force; and (d) a piercing member in the perforating gun, said piercing member adapted to rupture the rupture member upon the application of a mechanical force to the piercing member, thereby causing the hydrostatic pressure to be applied to the firing device and initiating the charge.

20. A method of perforating a formation in a wellbore at a predetermined location having a hydrostatic pressure, comprising:

(a) conveying a perforating gun in the wellbore, said perforating gun having, (i) a charge initiator for initiating a charge when said charge initiator is moved from a normal inoperative position;

(ii) a firing device in the gun, said firing device maintained at a pressure below the hydrostatic pressure, said firing device causing the initiator to move to initiate the charge upon the application of the hydrostatic pressure to the firing device; and (iii) a rupture member in the gun for maintaining the firing member at a pressure below the hydrostatic pressure, said rupture member allowing the hydrostatic pressure to be applied to the firing member when it is ruptured; and (d) applying a mechanical force to the rupture member of sufficient force to rupture the rupture member.

21. The method according to claim 20, wherein the mechanical force to the rupture member is applied by dropping a metal member in the housing.

* * * * *